US005303696A

United States Patent [19]

Boice

[11] Patent Number: 5,303,696

[45] Date of Patent: Apr. 19, 1994

[54] METHOD AND APPARATUS FOR IMPARTING CONTINUOUS PASSIVE MOTION TO JOINTS AND RELATED STRUCTURE

[76] Inventor: Steven D. Boice, 11607 Golden Given Rd. E., Tacoma, Wash. 98445

[21] Appl. No.: 95,154

[22] Filed: Jul. 20, 1993

Related U.S. Application Data

[63] Continuation of Ser. No. 803,640, Mar. 9, 1992, abandoned.

[51] Int. Cl.[5] ..... A61H 1/02

[52] U.S. Cl. ..... 601/33; 482/44; 482/47; 601/40

[58] Field of Search ..... 128/25 R, 26, 24 R, 128/25 B, 25 C, 67, 48, 49, 52, 53; 482/44, 47, 48, 900; 607/78, 111

[56] References Cited

U.S. PATENT DOCUMENTS

| | | | |
|---|---|---|---|
| 1,798,386 | 3/1931 | Roth | 482/47 |
| 1,833,357 | 11/1931 | Enzler | 128/26 |
| 3,756,222 | 9/1973 | Ketchum . | |
| 4,350,335 | 9/1982 | Pasbrig | 482/47 |
| 4,576,148 | 3/1986 | Koerner . | |
| 4,613,130 | 9/1986 | Watson | 128/26 X |
| 4,665,900 | 5/1987 | Saringer . | |
| 4,679,548 | 7/1987 | Pecheux | 128/26 |
| 4,875,469 | 10/1989 | Brook et al. . | |
| 4,949,711 | 8/1990 | Gyovai et al. | 602/21 |
| 4,962,756 | 10/1990 | Shamin . | |
| 5,113,849 | 5/1992 | Kulken et al. | 128/26 |

FOREIGN PATENT DOCUMENTS

| | | | |
|---|---|---|---|
| 650407 | 7/1985 | Switzerland | 482/47 |

*Primary Examiner*—Richard J. Apley
*Assistant Examiner*—John P. Leubecker
*Attorney, Agent, or Firm*—Stephen M. Evans; David L. Garrison

[57] ABSTRACT

A method and apparatus for imparting continuous passive motion to one or more joints, ligaments, or tendons is disclosed. The apparatus has a housing, an actuator, and a flexion/extension assembly. In preferred form, a main flexion cable links the actuator to a joint support member pivotally attached to flexion/extension assembly. Reciprocating motion of the main flexion cable causes the support member to oscillate. A restoring force, preferably a second main cable cooperative linked to the actuator, is present so as to urge the support member to its initial position. The path of motion of the support member can be altered, while the apparatus is in operation, by a cable deflecting assembly. By controlling the degree of cable deflection, the degree of support member motion can be altered. Variations to the apparatus include providing for multiple flexion cables, each linked to the main flexion cable, and multiple cable deflecting assemblies; a cable deflecting assembly associated with the second main cable for controlling the degree of extension; and a heat source affecting the area surrounding the flexion/extension assembly.

14 Claims, 7 Drawing Sheets

METHOD AND APPARATUS FOR IMPARTING CONTINUOUS PASSIVE MOTION TO JOINTS AND RELATED STRUCTURE

This is a continuation of copending application Ser. No. 07/803,640 filed on Mar. 9, 1992, now abandoned.

FIELD OF THE INVENTION

The present invention relates to the field of physical therapy and more specifically to the rehabilitation of injuries to human joints and related tissue by applying continuous passive motion (CPM) at a controllable, elevated temperature.

BACKGROUND OF THE INVENTION

It is well known in the field of medicine that there are predominantly two forms of physical damage that can occur to the human body: injury to hard tissue, e.g., bone or cartilage, and injury to soft tissue, e.g., skin, flesh, muscle, or tendon. Relating to the second type, soft tissue, and more specifically to tendon or ligament damage, recent studies have shown that contrary to the traditional practice of immobilizing an injured or healing joint, the joint should be subject to slow, continuous, and constrained motion to facilitate healing thereof. This type of therapy, it is proposed, is more beneficial to the surrounding cartilage and reduces the buildup of scar tissue that ultimately restricts mobility of the joint.

It is also well known that the application of heat to fibrous tissues such as tendons, joint capsules, and scar tissue causes these tissues to yield much more readily to tens heat reduces pain and relieves muscle spasms, and increases blood flow which helps to oxygenate the tissue and remove toxins. Consequently, heat is very beneficial to therapy associated with joint rehabilitation.

SUMMARY OF THE INVENTION

The present invention is a continuous passive motion apparatus comprising a housing having an actuator connected to a flexion/extension assembly constructed to impart variable flexion to one or more joints and thus, passive movement of tendons and ligaments associated with the one or more joints. Adjustments to the amount of joint flexion can occur while the apparatus is in operation, thus permitting progressive therapy to take place without having to stop the apparatus or adjust the joint-apparatus interface. Beneficial modifications to the invention include assisted extension complimentary to the assisted flexion, multiple joint flexion and extension, and use of a controlled temperature chamber surrounding the flexion/extension assembly to subject the joint(s) to therapeutic, elevated temperatures.

In a preferred embodiment, the invention is adapted to receive the wrist, palm, and fingers of a human hand. The flexion/extension assembly comprises a "U" shaped channel bracket having a cross member and two parallel legs wherein the legs are mounted to two pivot rods. The two pivot rods are in turn rotatably located in a supporting structure that is associated with the housing. Connected to the internal surface of the cross member are four flexion cables having four finger attaching means. The four cables extend from the pivotal bracket and pass through a common guide rod located aft of the bracket pivot rods. The common guide rod performs two functions: it assists in supporting a patient's hand during therapy and ensures proper flexion cable spacing and alignment. After emerging from the guide rod, the four flexion cables merge to form a common, main flexion cable. This main flexion cable is routed through a low friction guide orifice in the housing that is preferably above and near the periphery of the actuator which is preferably a rotatable drive platter. The main flexion cable depends towards the actuator and is rotatably attached thereto. The actuator, in turn, causes the main flexion cable to move in a reciprocating manner outside of the housing. This reciprocating motion is transmitted to the bracket via the four flexion cables which causes the bracket to pivot. When fingers from a hand are secured to the finger attachment means located on the flexion cables, the fingers undergo a desired flexion motion.

Also connected to the actuator at the same location and in the same manner as the flexion cable is one end of an extension cable. The function of this cable is to restore the bracket to its starting position. Consequently, the extension cable is attached at the other end to the bracket of the flexion/extension assembly so as to cause the bracket to pivot upwardly when acted on by the actuator. By locating a low friction extension cable guide orifice at a location above the drive platter but substantially opposite the flexion cable guide orifice, the motion of the extension cable is proportionately opposite to that of the motion of the main flexion cable when observed from outside the housing. Thus, the flexion cable acts in harmony with the extension cable—assisted flexion only occurs when there is no assisted extension and vice versa.

A feature of the invention permits adjustments to be made to the amount of flexion and extension imparted to each finger joint of a hand engaged with the apparatus. Moreover, these adjustments can be made while the device is in operation. The invention accomplishes this feature in a preferred embodiment by altering the effective path of cable travel of the flexion and extension cables between two fixed points. This alteration of the path of cable travel causes the beginning and ending position of the bracket and the fingers to change, thereby changing the degree of flexion and extension of each finger joint.

Increasing or decreasing either the flexion or extension cable travel path can be accomplished by lengthening or shortening the length of cable between two, fixed cable guides. Because these cable guides are intentionally located intermediate the actuator and the pivotal bracket, increasing the length of cable between these two guides causes the bracket to pivot: increasing the length of a flexion cable causes an increased degree of flexion for a joint associated with that cable; and increasing the length of the extension cable causes an increase in the degree of extension.

This feature is especially desirable for patients having unequal flexibility as between the fingers of the hand. In these situations, progressive flexion of one or more finger joints can occur independently of the other finger joints. Moreover, if the therapy calls for reaching certain flexion goals, such goals can be individually tailored for each finger. Thus, a patient can realize some of his or her goals, and receive the psychological benefits attendant thereto.

It should be noted that while the foregoing description of the invention discussed movement of the pivotal bracket which is connected to the various flexion cables and to the extension cable, it is the secured attachment of the phajanges (fingertips) of the hand to the associated flexion cables that creates the desired flexion. The bracket acts as a guide path for finger joint flexion and reference to the motion of the bracket provides a convenient method to describe the overall function of the invention.

Another feature of a preferred embodiment provides for a heat source which directs warmed air to an enclosure that surrounds the hand, thus beneficially providing a heated environment to assist the therapeutic healing process associated with continuous passive motion treatment of injured joints and associated soft tissues. The heat source is preferably variable and controllable to provide maximum flexibility depending upon the parameters prescribed for therapy.

The present invention also includes the method of using the apparatus described above, including the steps of:

a) positioning one or more joints on a joint bending surface and securing proximal structures associated with the one or more joints;
b) fixedly attaching distal structures associated with the one or more joints to a means for providing flexion and extension wherein the means for providing flexion and extension further provides controlled motion of the distal structures and the one or more joints through an adjustable path;
c) setting the parameters of the adjustable path; and
d) operating the means for flexion and extension repeatedly to move the one or more joints and associated distal structures through a predetermined path whereby the one or more joints and surrounding ligaments, tendons, and soft tissues are subjected to passive motion,

DETAILED DESCRIPTION OF THE INVENTION

Figure 1:
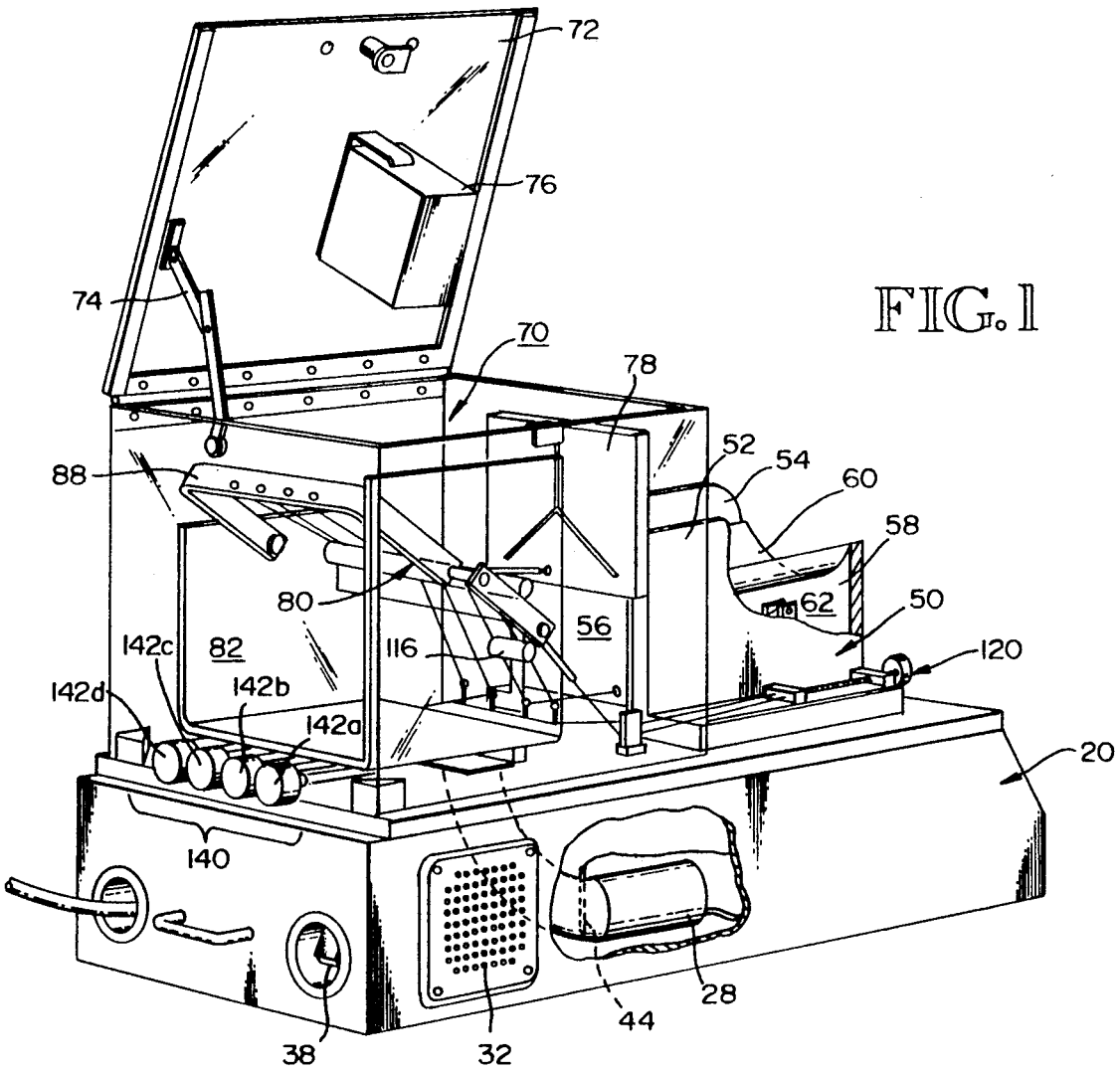
FIG. 1 is a perspective view of a preferred embodiment of the invention showing a housing in partial cut away, an arm support assembly in partial cut away, a controlled temperature chamber, a flexion/extension assembly generally enclosed by the controlled temperature chamber, an extension control assembly, and a flexion control assembly.

Referring now to the several figures wherein like numbers indicate like parts, a perspective view of the invention is shown in FIG. 1. The invention has a housing 20, an arm support assembly 50, a controlled temperature chamber 70, a flexion/extension assembly 80, an extension control assembly 120, and a flexion control assembly 140.

Figure 2:
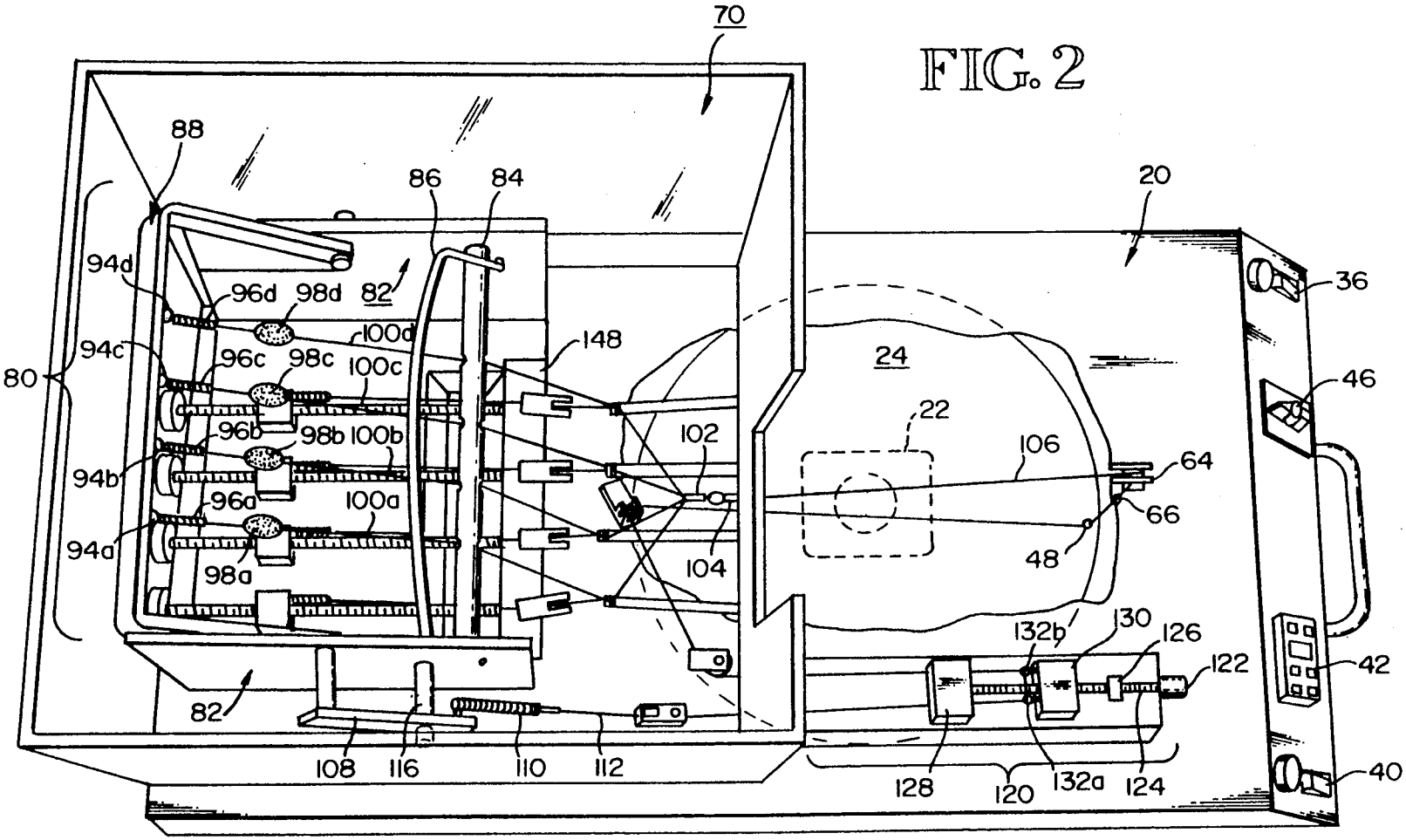
FIG. 2 is a top view of a preferred embodiment of the invention with cutaways to show a drive platter and motor.

Turning to FIG. 2, a top view of the internal components of the invention are shown. Housing 20 is preferably constructed of a solid, durable material such as laminated wood or heat resistant plastic. Internal to housing 20 is an actuator in the form of rotatable drive platter 24 (shown in a cut away section and in partial phantom) mounted to motor 22 (shown in phantom). In a preferred embodiment, drive platter 24 has a radius of approximately 22.9 centimeters (9 inches), and motor 22 is a geared type reduction motor designed to rotate at approximately 6–8 revolutions per minute. As will be discussed later, motor 22 and drive platter 24 determine not only the rate of flexion and extension of a finger joint when a hand is engaged with the device, but also determine the relative beginning and ending points of the arc of flexion and extension. Those persons skilled in the art will realize that a variety of actuators are possible: mechanical, hydraulic, electro-mechanical, etc. All that is required for use with the described flexion/extension assembly 80 is an appropriate periodic, linear movement of flexion cables 100*a*–100*d* between guide rod 84 and guide 64.

Figure 4:
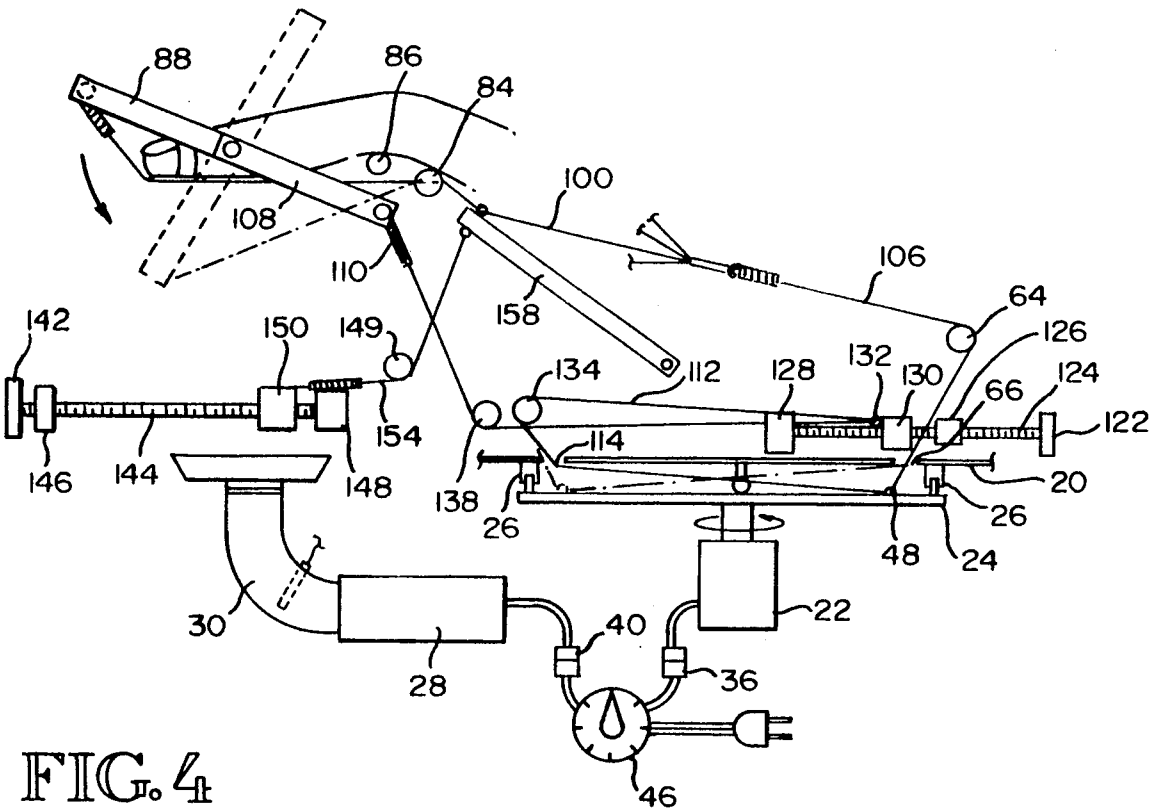
FIG. 4 is a side view of a simplified component schematic of a preferred embodiment of the invention with the flexion and extension adjustment assemblies set to provide minimal flexion with assisted extension.
Figure 5:
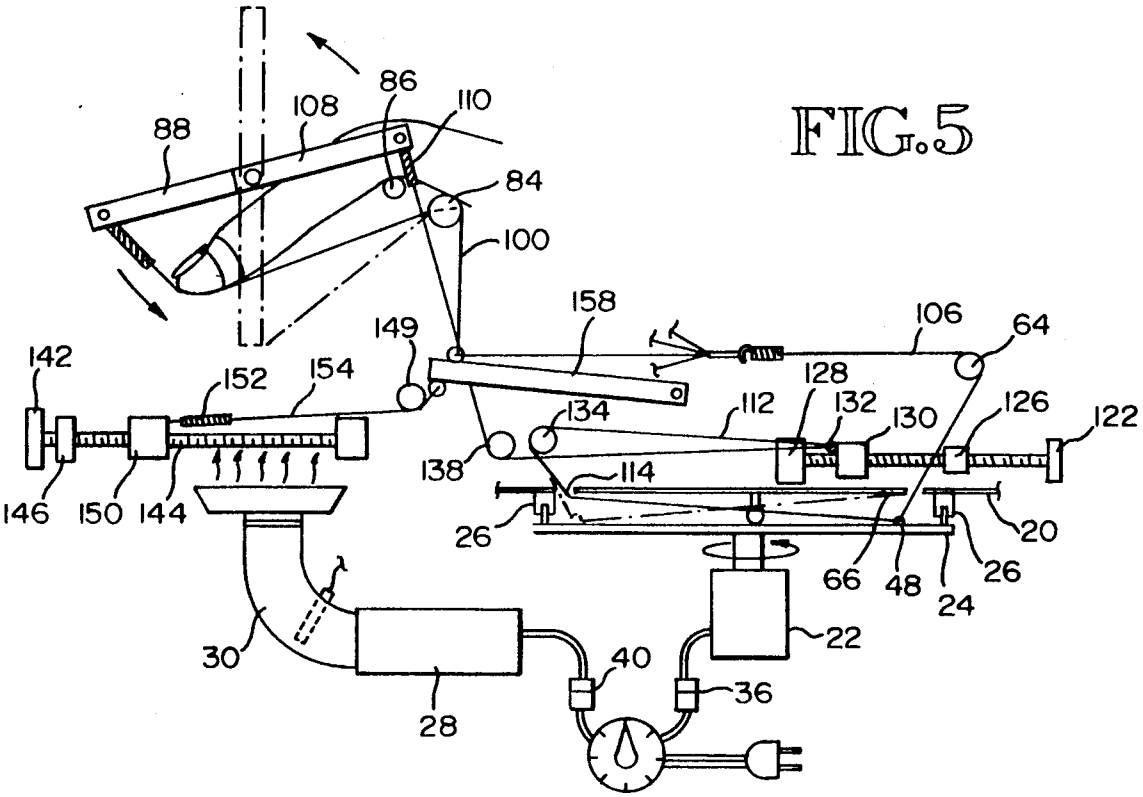
FIG. 5 is similar to FIG. 4 except that the flexion assembly is set to provide maximal flexion with assisted extension.

Also associated with drive platter 24 are stabilizing wheels 26. These wheels, as best shown in FIGS. 4 and 5, prevent drive platter 24 from deviating from planar rotation. Because both main flexion cable 106 and main extension cable 112 are rotatably connected to drive platter 24 at attaching point 48, an imbalance of drive platter 24 occurs upon tensioning of either or both cables. To counteract this imbalance, stabilizing wheels 26 are mounted to a stable surface such as the interior top portion of housing 20 and ride on a circular path which is on the outermost periphery of drive platter 24 so as not to interfere with cable attaching point 48 or its associated cables which operate inwardly of guide wheels 26.

Heat source 28 in the preferred embodiment is a resistance type convection heater. As illustrated in FIG. 1, heat source 28 is located with its output directed into riser 30 which directs heated air into controlled temperature chamber 70. Outside air is brought to intake orifice 32 of heat source 28 by means of vent 34. The purpose of heat source 28 is to direct heated air to a patient's tendons, ligaments, and joints that have been placed within controlled temperature chamber 70 to enhance the healing process. Again, those persons skilled in the art will understand that other means for providing heat to the patient's hand are possible. Examples include direct application of heat such as by heat packs or the like, radiant heat such as by infrared lights, or conversion heat processes such as by directed microwaves, shortwaves, or ultrasound. The inventor has found, however, that the present embodiment permits the greatest and most uniform presentation of heat to the treated areas, and can easily be controlled or regulated. Moreover, the present embodiment is inexpensive and effective.

Figure 6:
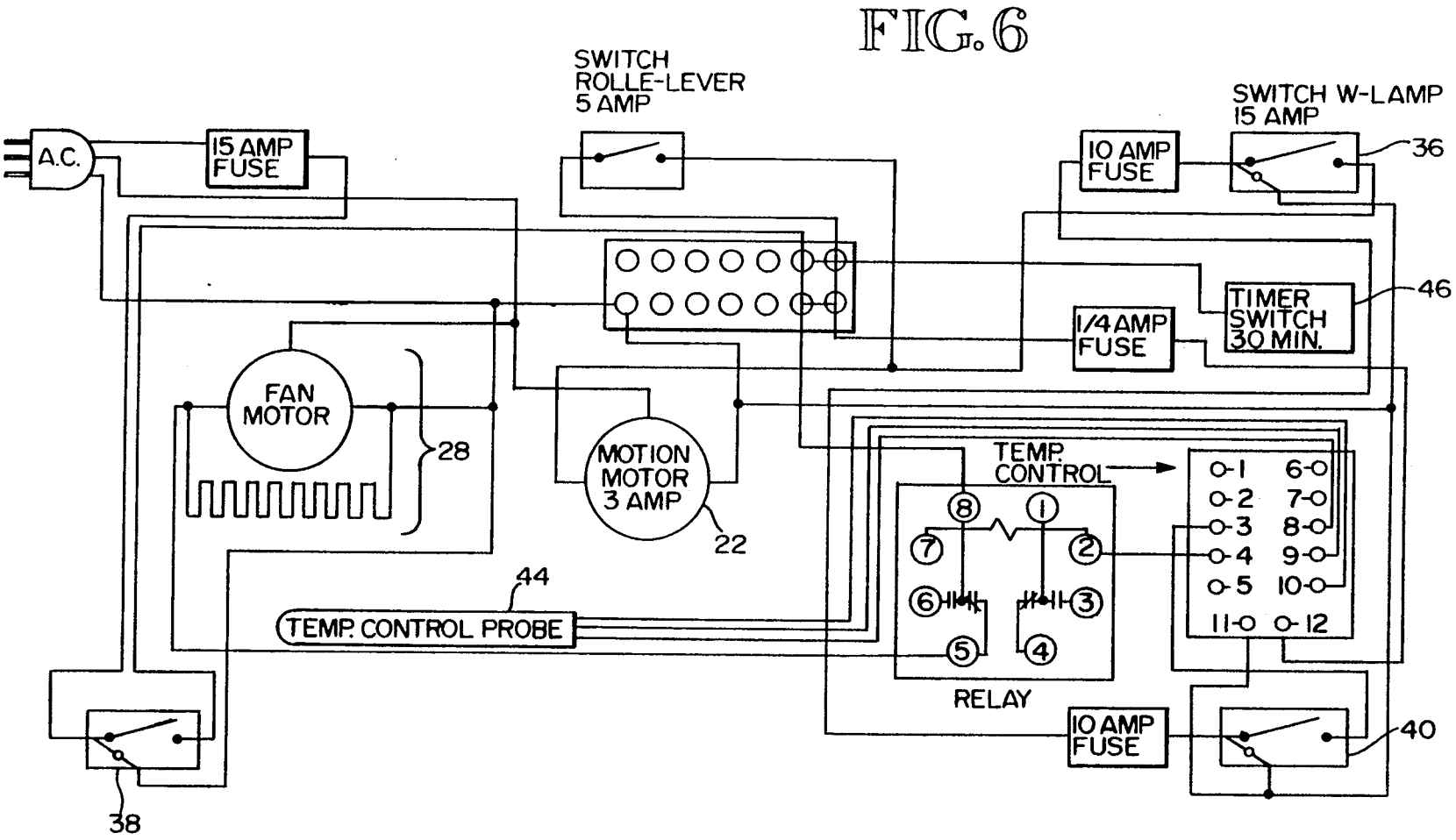
FIG. 6 is a schematic of the electrical components of a preferred embodiment.

Referring to both FIGS. 1 and 2, main power switch 38, heat switch 40, temperature control panel 42 and temperature probe 44, motion switch 36, and timer switch 46 are shown. As best illustrated in FIG. 6, main power switch 38 controls the activation of all the all electrical components of the device. Once main power switch 38 is closed, the aforementioned switches and panel are functional. In the preferred embodiment, timer switch 46 operates as a master switch in that it controls electrical power to all remaining electrical components of the device. Consequently, timer switch 46 must also be closed before the device can be activated. Therefore, timer switch 46 controls the duration of the therapy session.

Heat switch 40 in combination with temperature control panel 42 and temperature probe 44 control heat source 28. As best shown in FIG. 1, temperature probe 44 is located in the void defined by riser 30 and senses the temperature of heated air passing therethrough. By selecting a desired temperature via temperature control panel 42 which in the present embodiment is a touch sensitive entry panel, controlled temperature chamber 70 will be maintained at or near the selected temperature.

Returning again to FIG. 6, motion switch 36 controls motor 22. If it is desirable to vary the period of rotation of drive platter 24, an appropriate potentiometer or rheostat may be substituted or used in addition to motion switch 24.

Arm support assembly 50, as best shown in FIG. 1, comprises side support 52, side support 54, rear support 56, and front support 58 all of which define void 62. All support members are preferably constructed of the same material as used for constructing housing 20. Located on the upper periphery of arm support assembly 50 is saddle 60. Saddle 60 is constructed so as to comfortably accept and support a forearm placed thereon. To this end, saddle 60 is preferably constructed of a rigid surface covered with foam material having a protective skin.

Located in housing 20 and in void 62 are cable guide 64 and low friction orifice 66 through which main flexion cable 106 passes (see FIG. 2). Main flexion cable 106 then rotatably connects to drive platter 24 at cable attaching point 48. As will be discussed later, rotation of drive platter 24 in conjunction with the location of orifice 66 changes the rotational motion of drive platter 24 into reciprocating motion of main flexion cable 106. This reciprocating motion of main flexion cable 106 in turn causes flexion cables **100*a*–100*d* to be pulled in towards and let out from cable guide rod 84, thereby causing flexion bracket 88 to pivot as shown in FIGS. 4 and 5**.

Directly adjacent arm support assembly 50 is controlled temperature chamber 70. Controlled temperature chamber 70 is preferably constructed of clear, rigid acrylic plastic to provide a suitably stable enclosure and a convenient means for visual observation of a hand undergoing therapy. Referring specifically to FIG. 1, controlled temperature chamber has hinged cover 72 and strut 74 which locks in the open position so as to facilitate hook up and removal of a patient's hand within the device. Because controlled temperature chamber 70 receives heated air from heat source 28, it is desirable to limit the amount of heated air escaping from the chamber. To this end heat retaining cuff 78, which is designed to permit penetration by a hand and wrist therethrough, is intermediate controlled temperature chamber 70 and arm support assembly 50 to maintain a relatively air tight seal around a patient's forearm. Also shown and located within controlled temperature chamber 70 is hand stabilizer 76 which maybe constructed from a resilient foam rubber type material. Hand stabilizer 76 generally immobilizes the metacarpal bones of a patient's hand when cover 72 is closed to enhance the flexion of the metacarpal-phalange joints while the apparatus is in operation.

Figure 2A:
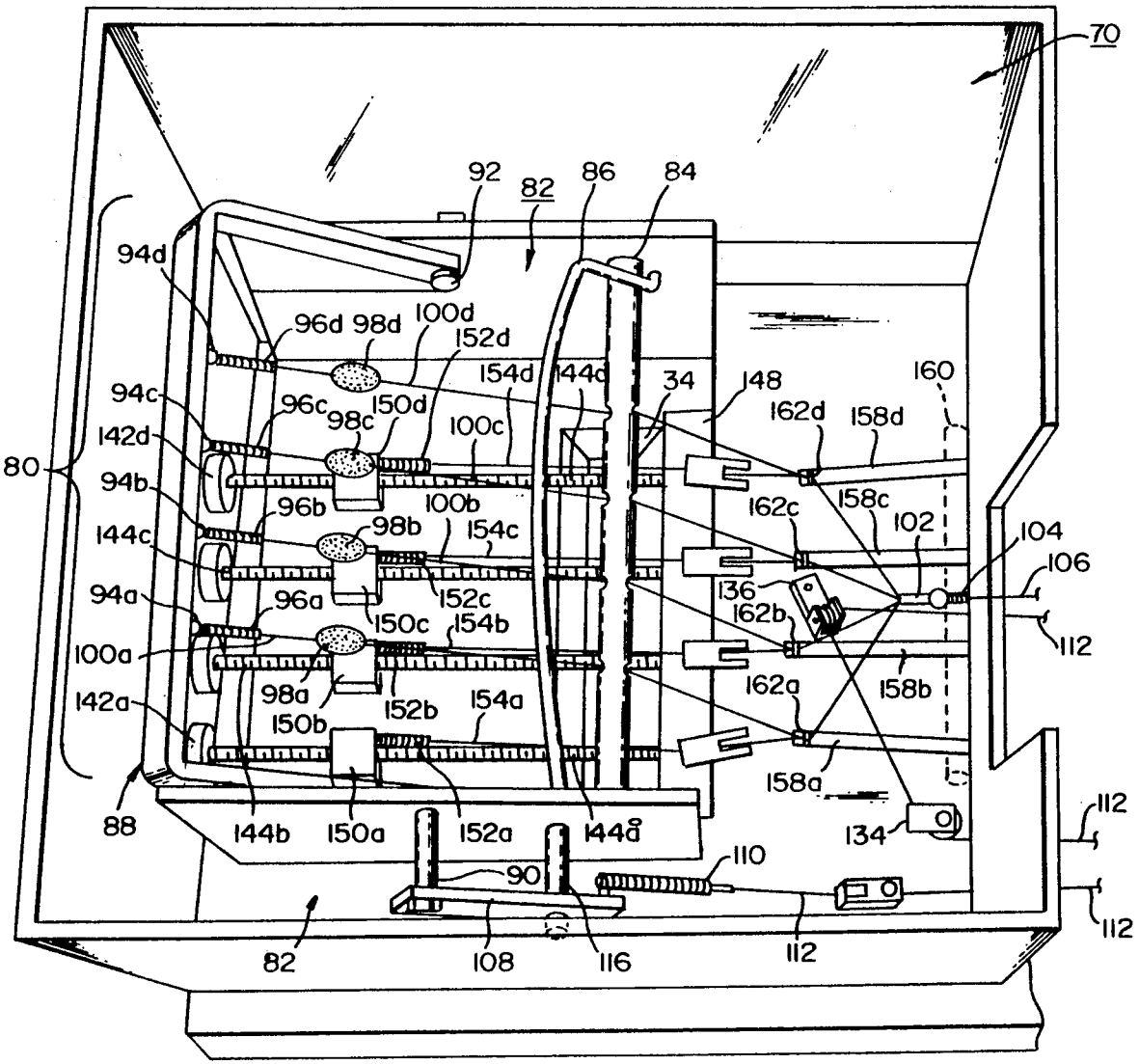
FIG. 2A is an enlarged view of FIG. 2, better showing the elements comprising the flexion/extension assembly and flexion adjustment assembly in a preferred embodiment.

FIG. 2A best illustrates the various components contained in controlled temperature chamber 70. Flexion-/extension assembly 80 comprises support member 82, cable guide rod 84 which also provides support to a patient's palm, joint bending support 86, bracket 88, and pivot rods 90 and 92. Both support member 82 and bracket 88 are preferably formed from "U" shaped channel sections of structural acrylic material.

Cable guide rod 84 and joint bending support 86 are internally mounted to support member 82. Bracket 88 is located adjacent the internal, vertical surfaces of support member 82 by pivot rods 90 and 92. Pivot rods 90 and 92 are fixedly attached to bracket 88 and pivotally mounted in support member 82. Inserted into the inside surface of the cross member of bracket 88 are four eyelets **94*a*–94*d* to which are attached flexion springs 96*a*–96*d*. Connected to these springs are flexion cables 100*a*–100*d*. Flexion cables 100*a*–100*d* extend from flexion springs 96*a*–96*d* and pass through cable guide rod 84 which maintains proper spacing between each flexion cable 100. After passing through cable guide rod 84, flexion cables 100*a*–100*d* collect at one end of compression sleeve 102. Attached at the other end of compression sleeve 102 is main flexion spring 104 which in turn is connected to main flexion cable 106. As previously discussed and best shown in FIG. 2, main flexion cable 106 passes through housing 20 and is rotatably secured to driver platter 24 at cable attaching point 48. Springs 96*a*–96*d* allow finger attachment means 98*a*–98*d* to be positioned more accurately for any given finger length. Main flexion spring 104 buffers the motion from drive platter 24 to flexion/extension assembly 80**.

Integrated with flexion cables **100*a*–100*d* are four finger attaching means 98*a*–98*d*. These finger attaching means, such as hook or loop fastening surfaces, are used to connect a patient's distal phalanges or fingertips to flexion cables 100*a*–100*d* (see for example FIG. 3). While the inventor has illustrated this embodiment, it is to be understood that numerous means exist for connecting fingertips to flexion cables 100*a*–100*d***; some of which depend in large part upon design considerations.

Also shown in this figure is extension cantilever 108 which is fixedly attached at one end to pivot rod 90, Since pivot rod 90 is also fixedly attached to bracket 88, a downward motion by bracket 88 causes a corresponding upward motion by extension cantilever 108. Connected to the other end of extension cantilever 108 is main extension spring 110. Main extension spring 110 can either be used passively or actively: In a passive embodiment, main extension spring 110 is connected to housing 20 to provide passive extension i.e. main extension spring 110, which is in tension, would provide the necessary restoring force to cause bracket 88 to return to its initial starting position and cause a finger joint to undergo extension; or in an active embodiment main extension spring can be connected rotatably to drive platter 24 via main extension cable 112. This active extension embodiment is illustrated in the several figures.

As best shown in FIG. 2, main extension cable 112 is first connected to main extension spring 110 and passes through guide 138 and eyelets **132*a* and 132*b*. Eyelets 132*a* and 132*b* reverse the direction of main extension cable 112. Main extension cable 112 then passes through guide 134 and guide 136 so as to cause main extension cable 112 to pass through low friction orifice 114 (not shown in this FIG.) which is located directly below guide 136 where upon cable 112 rotatably attaches to drive platter 24 at cable attaching point 48. It is important to note that while orifice 114 is located radially opposite from orifice 66, main flexion cable 106 and main extension cable 112 are rotatably attached to drive platter 24 at the same location. Consequently, when drive platter 24 rotates, an alternating and reciprocating motion occurs between main flexion cable 106 and main extension cable 112. Thus, only a single actuator is necessary to impart motion to main flexion cable 106 and main extension cable 112**.

Thus far, only the flexion and extension aspects of the device have been described. An important feature of the invention is its ability to adjust and control the beginning and ending locations of assisted flexion and extension. Moreover, this adjustment can, and should, occur while the device is in operation. The following description relates to the various control components.

The invention has the ability to alter the effective travel path of a cable between two guide points in order to adjust the degree of assisted flexion imparted to one or more joints. Because one end of both main flexion cable 106 and main extension cable 112 is rotatably attached to drive platter 24 and the other end of each cable is attached to pivotal bracket 88, altering the effective travel path of either cable between any two non-movable cable guides will cause a corresponding and proportional movement by bracket 88. Consequently, distal extensions of a joint will similarly be caused to move. During operation of the apparatus, this change in the position of bracket 88 translates into increased or decreased flexion of finger joints. For example, increasing the effective travel path of main extension cable 112 between cable guide 134 and cable guide 138 will cause extension cantilever 108 to pivot until stopped by cantilever stop 116. Conversely, decreasing the effective travel path of main extension cable 112 between these cable guides will permit extension cantilever 108 to pivot in an opposite direction if so urged. Control over the degree of flexion is similarly changed and will be discussed in greater detail below. Thus, changing the effective travel path of either a flexion cable or an extension cable between any two non-movable guides will cause a corresponding change in the beginning and ending location of bracket 88 when caused to pivot by drive platter 24.

FIG. 2 illustrates a preferred method for changing the effective travel path of main extension cable 112 by using extension control assembly 120. Extension control assembly 120 generally comprises threaded rod 124 which is rotatably located in mounting block 126 and retaining block 128, and adjusting block 130 which is threadably engaged with threaded rod 124. Knob 122 permits rotation of threaded rod 124.

Attached to threaded adjusting block 130 are two eyelets **132*a* and 132*b* which reverse the direction of main extension cable 112. Depending upon design considerations, it may be desirable to utilize a sheave or turning bock to reduce the friction occurring at this location. As will be discussed in greater detail below, turning knob 122 causes adjusting block 130 to axially travel threaded rod 124 which changes the relative location at which main extension cable 112** reverses direction, thus increasing or decreasing its effective travel path.

A similar method for changing the effective travel path of main flexion cable 106 is employed by the flexion control assembly. As shown best in FIGS. 2A and 3, the flexion control assembly comprises threaded rods **144*a*–144*d* which are rotatably located in mounting block 146 and retaining block 148. Adjusting blocks 150*a*–150*d* are threadably engaged with threaded rods 144*a*–144*d* and axially travel along threaded rods 144*a*–144*d* by turning knobs 142*a*–142*d*. Attached to threaded adjusting blocks 150*a*–150*d* are corresponding springs 152*a*–152*d* to which are connected flexion adjusting cables 154*a*–154*d* which pass through cable guides 149*a*–149*d*. The free ends of flexion adjusting cables 154*a*–154*d* are connected to eyelets 156*a*–156*d* which are anchored to the bottom surface at a free end of corresponding flexion adjusting members 158*a*–158*d*. Anchored to the top surface at the free end of flexion adjusting members 158*a*–158*d* are eyelets 162*a*–162*d*. Flexion cables 100*a*–100*d* are sequentially located through each corresponding eyelet 162*a*–162*d*. The end opposite the free ends of flexion adjusting members 158*a*–158*d* are pierced by pivot rod 160 which is preferably mounted to housing 20 (See FIG. 2A). From the above described configuration of components, it should be seen that by passing flexion cables 100*a*–100*d* through eyelets 162*a*–162*d*, the relative travel path of flexion cables 100*a*–100*d* between cable guide rod 84 and guide 64 (See FIG. 2) can be adjusted independently by varying the inclination of each flexion adjusting member 158. This adjustment, in turn, determines the relative degree of flexion of each joint associated with a particular flexion cable 100**.

To carry out the inclination adjustment of flexion adjusting members **158*a*–158*d*, knobs 142*a*–142*d* are rotated causing threaded adjusting blocks 150*a*–150*d* to axially travel along threaded rods 144*a*–144*d*. Because flexion control cables 154*a*–154*d* are connected to threaded adjusting blocks 150*a*–150*d* at one end and flexion adjusting members 158*a*–158*d* at another end, the degree of inclination of flexion adjusting members 158*a*–158*d* can be altered upwardly or downwardly by the axial movement of threaded adjusting blocks 150*a* and 150*d*. Thus, a change in the effective travel path of flexion cables 100*a*–100*d* is effectuated by rotating corresponding knobs 142*a*–142*d***.

PREPARATION FOR OPERATION OF THE INVENTION

Operation of the invention can be initiated by closing main power switch 38 and entering the desired temperature to be maintained in controlled temperature chamber 70 via temperature control panel 42. To preheat controlled temperature chamber 70, timer switch 46 is set to the maximum time and heat switch 40 is closed. The device is now preheating.

Figure 3:
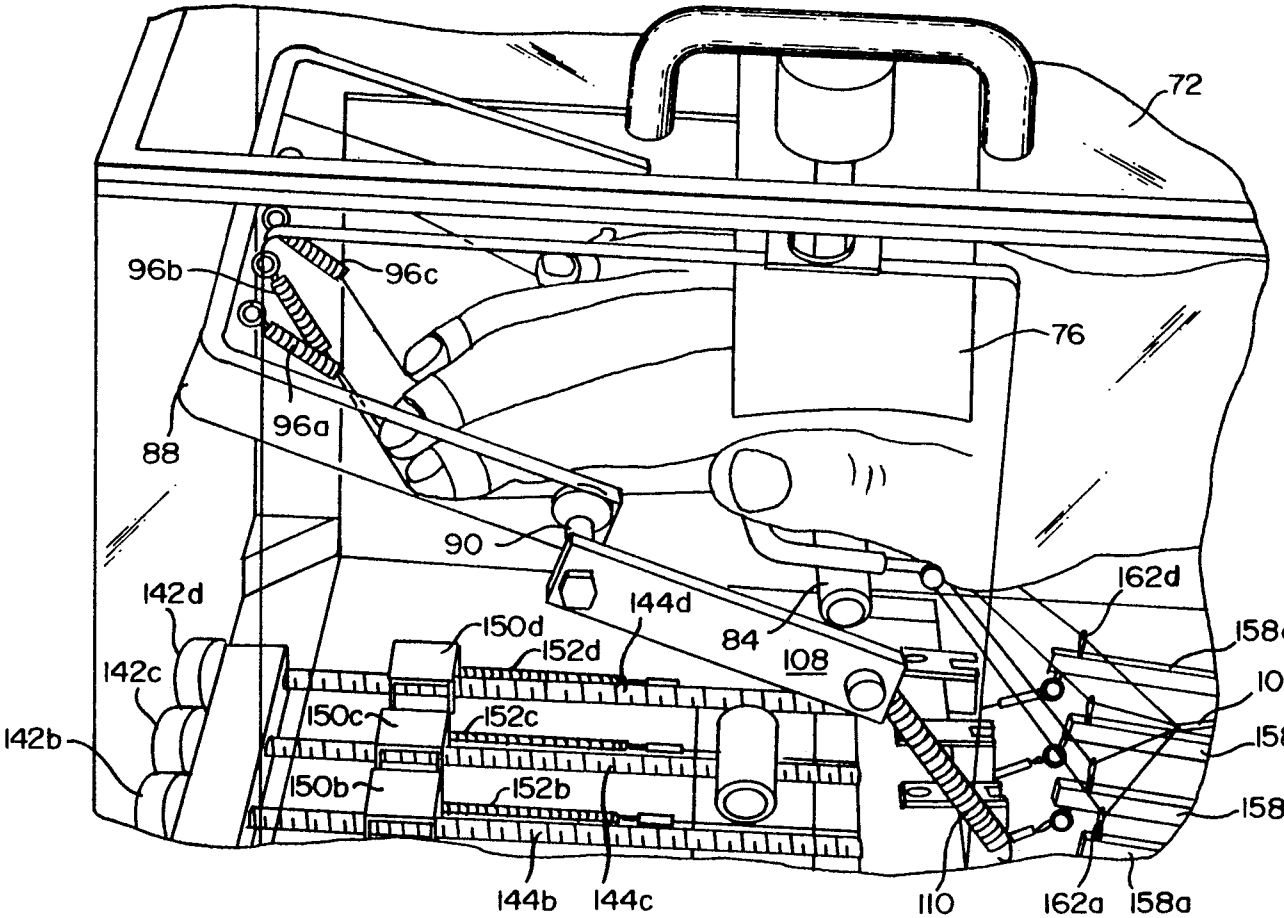
FIG. 3 is a perspective view showing a hand engaged with a preferred embodiment of the invention.

The next step involves attaching a patient's fingertips to one or more flexion cables **100*a*–100*d*. As illustrated in FIG. 3, a patient's hand is inserted into controlled temperature chamber 70 with the palm being located on cable guide rod 84 and the metacarpal-phalange joints being located on joint bending support 86. Complimentary portions to finger attaching means 98*a*–98*d* are secured to the patient's fingertips and are mated to attaching means 98*a*–98*d***.

After completing the above described steps, timer switch 46 is reset to the desired duration of therapy and motion switch 36 is closed thereby activating the apparatus.

OPERATION OF THE INVENTION

To simplify discussion of the operation of the invention, reference should be made to FIGS. 4 and 5 wherein a functional side view of the essential components of the invention are shown, e.g. main flexion cable 106 and main extension cable 112 and associated components. For simplicity and clarity, reference is made only to the flexion and extension of the joints of one finger—the index finger of a right hand inserted into controlled temperature chamber 70. Consequently, no suffixes will be used. It is to be understood that similar flexion and extension would occur with respect to the remaining fingers.

In FIG. 4, the device is shown having an initial flexion and extension control setting with an extended position being shown in solid lines and a flexed position being shown in dashed lines. Attention should be drawn to the positions of adjusting block 150 and adjusting block 130. In FIG. 5, the device is shown having an increased flexion control setting with an extended position being shown in solid lines and a flexed position being shown in dashed lines. Again, attention should be drawn to the positions of adjusting block 150 and adjusting block 130 as well as the increased rotational stopping position of bracket 88 which results from the increased effective travel path of flexion cable 106 and 100 between cable guide rod 84 and guide 64.

Referring then generally to both figures, activation of motion switch 36 and timer switch 46 causes motor 22 to rotate drive platter 24. Because both main flexion cable 106 and main extension cable 112 are rotatably connected to drive platter 24 at cable attaching point 48, and because orifice 66 is located radially opposite from orifice 114, main flexion cable 106 and main extension cable 112 will be in reciprocating motion after emerging from their respective orifices. Simply stated, when main flexion cable 106 is being taken in, main extension cable 112 is being let out. This configuration permits a unitary attaching point 48, thereby simplifying the construction of the actuator and eliminating a synchronous motion.

To change the starting and stopping position of bracket 88 and more particularly the finger attached to flexion cable 100, one need only rotate knob 142 to adjust the degree of flexion and rotate knob 110 to provide the necessary complimentary degree of extension. Before proceeding with describing the function of each adjustment, it should be noted that flexion control assembly 140 does not vary the stroke or linear distance of cable travel, but instead alters the beginning and ending flexion location of the finger affixed to flexion cable 100. In the preferred embodiment, wherein four fingers are flexed, complete flexion control is available for each individual finger. This aspect of the invention is critical for patients who may have unequal tendon travel or the like (either during the flexive or extensive cycle). Extension control assembly 120 provides the necessary restoring force to bring the finger back to its initial position.

During operation and as knob 142 is rotated, threaded rod 144 causes linear movement of threaded adjusting block 150. Movement of threaded adjusting block 150, via flexion control cable 154 permits flexion adjusting member 158 to pivot upward when urged to do so. Flexion adjusting member 158 pivots upward during operation of the device when adjusting block 150 moves away from knob 142. Consequently, main flexion cable 106 and flexion cable 100 are nearly straight and their effective travel path is short; the index finger can begin its flexion at a point more horizontal than if adjusting block 150 were located proximate to knob 142 as is shown in FIG. 5.

Turning then to FIG. 5, positioning threaded adjusting block 150 near knob 142 causes flexion adjusting member 158 to locate near the horizontal, thereby increasing the effective travel path of main flexion cable 106 and flexion cable 100 between guide rod 84 and guide wheel 64. As a result, the index finger begins flexion at a point more towards vertical (downward) than previously set. Again, because the stroke or linear travel of the flexion cables are fixed, only the starting and ending position of the index finger flexion is changed.

Extension control assembly 120 operates in a similar manner—altering the starting and stopping position of extension by causing bracket 88 to begin pivoting upwardly at a position determined by the location of threaded adjusting block 130. Adjusting block 130 increases or decreases the effective travel path of main extension cable 112 between guide wheel 134 and guide wheel 138. Again, since the stroke of main extension cable 112 is fixed, only the starting and ending position of the index finger extension is changed. Therefore, extension adjustment is made to cooperate with the relative position of bracket 88 as is determined by flexion control assembly 140.

The geometry of flexion control assembly 140 advantageously permits adjustment of the individual finger flexion while the device is in operation. Those persons skilled in the art will appreciate this ability since therapy for rehabilitating damaged tendons relies on progressive treatment. This progression may sometimes occur during a single therapy session. Therefore, it is desirable to have a device able to progressively change the flexion of the fingers while the device is in operation. To enhance such a progressive therapy treatment, the inventor has contemplated the use of power assisted means for adjusting the starting and stopping locations of finger flexion. For example, by incorporating stepper motors connected to threaded rods 144*a*–144*d* as is shown in FIG. 2A, progressive flexion of the fingers can be easily accomplished when, for example, the stepper motors are controlled by a timing circuit or a microprocessor programmed with the desired parameters of therapy.

INDUSTRIAL APPLICABILITY

The invention will find utility in the field of rehabilitative therapy for persons who have suffered injuries to joints, tendons, ligaments, or muscles. By imparting continuous passive motion to persons having these and other related injuries or conditions, a significant reduction in post injury conditions will result.

What is claimed is:

1. A continuous passive motion apparatus for causing flexion and extension to a joint, ligament, or tendon comprising:

a housing;

an actuator;

a flexion/extension assembly having a support member pivotally attached to the housing and linked to the actuator by a first main cable, wherein the actuator imparts movement of the support member in a first direction;

means for connecting a distal portion of a joint to the support member, wherein the means for connecting comprises at least one flexion cable located intermediate the first main cable and the support member, the at least one flexion cable being attached at one end to the first main cable and attached at a second end to the support member;

a flexion control assembly having at least one cable adjusting means located intermediate the actuator and the flexion/extension assembly for deflecting the at least one flexion cable from the effective travel path, thereby controlling the degree of motion of the support member; and means for imparting movement of the support member in a second direction, wherein the second direction is substantially opposite the first direction.

2. The apparatus of claim 1 wherein the means for imparting movement of the support member in a second direction comprises a second main cable and a spring, the second main cable being attached to the support member at one end and to the spring at another end, and the spring being attached at one end to the housing.

3. The apparatus of claim 2 further comprising an extension control assembly having a cable adjusting means located intermediate the housing and the flexion-/extension assembly for deflecting the second main cable from its effective travel path, thereby controlling the degree of motion of the support member.

4. The apparatus of claim 1 wherein the means for imparting movement of the support member in a second direction comprises a second main cable cooperatively linked to the actuator at one end and linked to the support member at another end.

5. The apparatus of claim 4 further comprising an extension control assembly having a cable adjusting means located intermediate the housing and the flexion-/extension assembly for deflecting the second main cable from its effective travel path, thereby controlling the degree of motion of the support member.

6. The apparatus of claim 1 wherein the at least one flexion control assembly cable adjusting means further comprises at least one cable adjusting member pivotally attached to the housing at a first end and slidingly engaged with the at least one flexion cable at a second end whereby a pivotal motion of the at least one cable adjusting means alters the effective travel path of the at least one flexion cable.

7. The apparatus of claim 6 wherein the at least one flexion control assembly cable adjusting means further comprises a pivot adjusting means.

8. The apparatus of claim 7 wherein the pivot adjusting means comprises a cable attached at a first end to the second end of the at least one cable adjusting member and attached at a second end to a cable length adjustment means.

9. The apparatus of claim 8 wherein the means for imparting movement of the support member in a second direction comprises a second main cable and a spring, the second main cable being attached to the support member at one end and to the spring at another end, and the spring being attached at one end to the housing; and an extension control assembly having a cable adjusting means located intermediate the housing and the flexion-/extension assembly for deflecting the second main cable from its effective travel path.

10. The apparatus of claim 1 wherein the support member comprises a bracket pivotally mounted to the flexion/extension assembly and the flexion extension assembly further comprises a joint support surface rigidly mounted thereto to support a joint placed thereon.

11. The apparatus of claim 1 further comprising a heat source to provide heat to an area surrounding the flexion/extension assembly.

12. The apparatus of claim 11 further comprising a controlled temperature chamber surrounding the flexion/extension assembly, wherein the chamber is coupled to the heat source.

13. A method for imparting continuous passive motion to an injured or healing joint, ligament, or tendon using an apparatus including a flexion/extension assembly, a joint support surface, a support member, and an actuating cable, comprising the steps of:

a) positioning at least one joint on a support surface and generally immobilizing proximal structures associated with the at least one joint;

b) fixedly attaching distal structures associated with the at least one joint to a flexion/extension assembly having a moveable support member connected to an actuating cable, wherein the support member provides controlled motion of the distal structures of the at least one joint through an adjustable path;

c) oscillating the support member repeatedly to move the distal structures associated with the at least one joint through a predetermined path whereby the at least on joint and surrounding ligaments, tendons, and soft tissues are subjected to passive motion; and d) altering, during oscillation, the degree of motion of the support member deflecting the actuating cable from its effective travel path.

14. The method of claim 13 further comprising the step of supplying heat to the at least one joint and surrounding bodily parts.

* * * * *